United States Patent [19]

Gonon

[11] 4,141,105

[45] Feb. 27, 1979

[54] CARRIER RING FOR DRAPERY ROD

[76] Inventor: Jean A. P. Gonon, Saint-Just-Malmont, France

[21] Appl. No.: 882,370

[22] Filed: Mar. 1, 1978

[30] Foreign Application Priority Data

Apr. 4, 1977 [FR] France ..... 77 10683

[51] Int. Cl.[2] ..... A47H 13/02

[52] U.S. Cl. ..... 16/87.6 R; 16/95 D; 16/96 D; 160/330; 160/346

[58] Field of Search ..... 16/87.6 R, 87.8, 91, 16/93 D, 93 R, 94 D, 94 R, 95 D, 95 R, 96 D, 96 R, 97, 98, 106, 107; 160/126, 345, 346, 347, 330; 104/93; 105/150

[56] References Cited

U.S. PATENT DOCUMENTS

| | | | |
|---|---|---|---|
| 1,813,170 | 7/1931 | Kimber | 160/126 |
| 2,538,434 | 1/1951 | Svendsen | 16/106 X |
| 2,654,114 | 10/1953 | Graber et al. | 16/87.6 R X |
| 3,058,147 | 10/1962 | Bell | 16/87.6 R |
| 3,095,033 | 6/1963 | Polkosnik | 160/126 X |
| 3,370,819 | 2/1968 | Kenney | 16/95 D |
| 3,392,420 | 7/1968 | Kless | 16/87.6 R |

*Primary Examiner*—Werner H. Schroeder
*Assistant Examiner*—Moshe I. Cohen
*Attorney, Agent, or Firm*—Browdy and Neimark

[57] ABSTRACT

A carrier ring is provided for use with the type of drapery rod having a longitudinal compartment therethrough, which ring can be easily drawn with only rolling friction even when used to hang a heavy drape. The ring has a pair of wheels able to roll along the bottom of the longitudinal compartment of the drapery rod which wheels have an axis of rotation passing through a web integral with the ring, which axis is offset longitudinally with respect to the median transverse plane of the ring. The front part of the web is sloped and the rear part is bevelled so that the bevelled part of one ring will force the sloped part of the other to rotate about the wheels when the drape is being opened. This construction permits the top of the ring to come out of contact with the rod both as the drape is being opened and as it is being closed.

1 Claim, 5 Drawing Figures

CARRIER RING FOR DRAPERY ROD

Field of the Invention

The present invention relates to a carrier ring for a drapery rod, particularly for use with rods having at least one longitudinal compartment communicating with the exterior of the top, the bottom of said compartment having tracks for the wheels of the draw ring or rings.

BACKGROUND OF THE INVENTION

In known rods of the type described hereinabove, the carrier rings associated with a draw ring rest directly on the upper part of the rod. Hence, when they support heavy drapes, they are forced against the rod; the increased friction necessitates a substantial effort to draw them and also causes them to wear, particularly when they are made of synthetic material.

SUMMARY OF THE INVENTION

Among the objects of the present invention is to provide a ring which overcomes these disadvantages and, in particular, can be easily drawn even when used to hang a heavy drape.

The ring in accordance of the present invention has a pair of wheels able to roll along the track and whose axis of rotation, passing through a web integral with the ring, is offset longitudinally with respect to the median transverse plane of the ring in a direction away from the draw ring.

Because of this, when the draw ring is pulled by the draw cord in the direction of closure of the drape, each of the carrier rings is subjected, by its lower end connected to the drape, to a force tending to make it pivot about its wheels. As a result, its upper part rises with respect to the rod and this does not tend to rub against it. Because of this, the various carrier rings are moved only by rolling, which reduces the resistive force which opposes drawing of the drape, thus eliminating all wear.

BRIEF DESCRIPTION OF THE DRAWINGS

The invention will be better understood with the aid of the description hereinbelow with reference to the schematic drawing attached representing, as a nonlimitative example, one embodiment of this carrier ring in the case of its application to a drapery rod.

DETAILED DESCRIPTION OF PREFERRED EMBODIMENT

Figure 1:
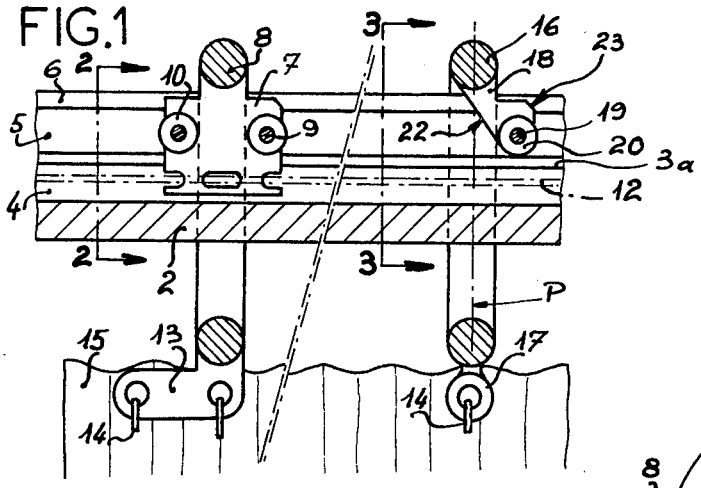
FIG. 1 is a longitudinal section of a drapery rod provided with a draw ring according to the present invention.
Figure 2:
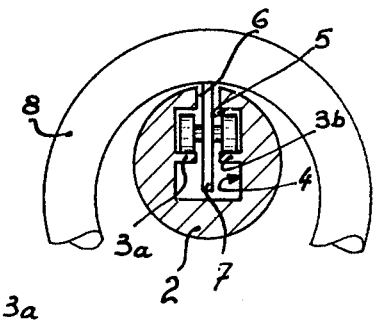
FIGS. 2 and 3 are transverse cross-sectional views along 2—2 and 3—3 in FIG. 1.

In these drawings, 2 designates a rod made of wood or synthetic material which is divided internally by two facing longitudinal ribs 3*a* and 3*b* into two compartments, a lower compartment 4 and an upper compartment 5. Upper compartment 5 communicates with the exterior by a longitudinal groove 6 extending along the entire length of the rod and enabling a web 7 of draw ring 8 to penetrate to the two compartments. This web 7 supports axles 9 of two pairs of wheels 10 able to roll on the upper surfaces of ribs 3*a* and 3*b* constituting the bottom of upper compartment 5. In addition, by means of its lower part, this web penetrates compartment 4 where it is connected to a draw cord 12. This draw ring is provided in its lower part with an arm 13 provided with holes to accept hooks 14 integral with drape 15.

In a known manner, draw ring 8 is associated with several carrier rings 16 provided in their lower parts with eyelets 17 for connection to the aforesaid hooks 14.

Figure 4:
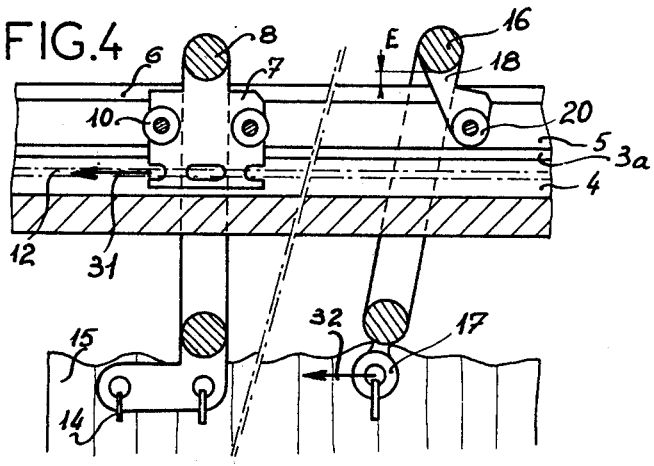
FIGS. 4 and 5 are longitudinal sections of the rod showing two of its rings with the drape in the open and closed positions.
Figure 3:
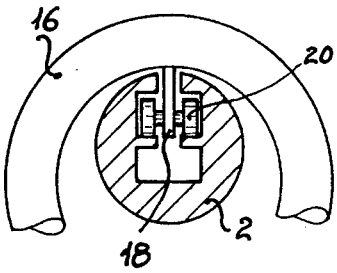
Figure 5:
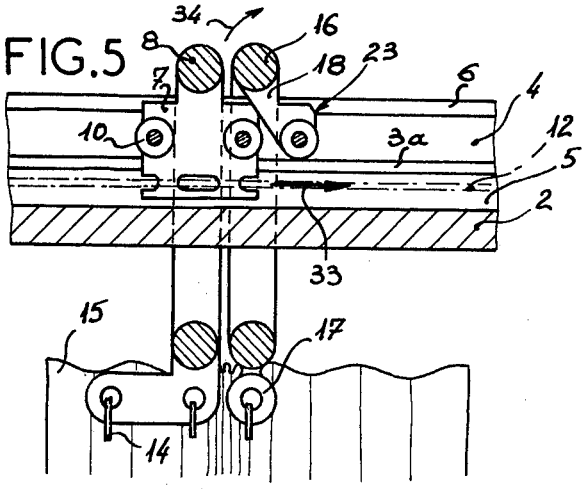

According to the invention, each draw ring 16 is integral with a radial inner web 18 which is traversed by an axle 19 supporting a pair of wheels 20. As shown in FIGS. 1, 4 and 5, this axle 19 is offset with respect to transverse median plane P of ring 16, away from draw ring 8. In this embodiment, axle 19 is offset with respect to the plane of the rear face of said ring 16 when moving in a closing direction.

The forward part of web 18 comprises a sloping part 22 inclined rearward from top to bottom, and is provided at its rearward part with a stop zone 23 in the form of a bevel.

When the drape is open and the user desires to draw it closed, he pulls on draw cord 12 which tends to cause draw ring 8 to move in the direction of arrow 31 in FIG. 4. This movement is transmitted by drape 15 to the lower part of each of carrier rings 16, as shown by arrow 32. This force tends to cause each of rings 16 to pivot on its wheels 20, namely it tends to cause each of the rings to move into the tilted position shown in FIG. 4. Due to this tilting, the upper part of each ring 16 is higher than the upper part of rod 2 and is thus separated from the latter by a gap E which makes it absolutely impossible for it to come into contact with said rod. As a result, movement of rings 16 is effected only by rolling with zero friction on the rod, which reduces the force required to draw the drape and eliminates all wear.

At the end of the closure movement and as soon as draw cord 12 is no longer being pulled by the operator, the weight of the drape exerted on eye 17 of each carrier ring 16 is sufficient to bring this ring into its normal vertical position shown in FIG. 1.

When the drape is closed and it is desired to open it, a pull on draw cord 12 in the direction of arrow 33 in FIG. 5 causes traveler 8 to move in the same direction. The upper part of its web 7 then comes into contact with sloping part 22 of web 18 of the first carrier ring which is thus, in its turn, moved in the same direction and comes into contact with web 18 of the following ring by its bevelled contact zone 23. It should be noted that the contact zones of the various rings are disposed above the axes of rotation of their wheels. Hence, each carrier ring 16 is subjected to a force which not only tends to move it in the direction of arrow 33 but also tends to cause it to pivot in the direction of arrow 34, namely to increase the gap between its upper part and the corresponding upper part of rod 22. Hence, even during their return movement, rings 16 move by rolling and thus there is no risk of their contacting the rod.

It emerges from the foregoing that the ring according to the invention, by means of its design, enables the friction, resulting from movement on a rod, to be considerably reduced and as a result the pulling force necessary to draw the curtain as well as the wear of the moving parts should be considerably reduced.

It will be obvious to those skilled in the art that various changes may be made without departing from the scope of the invention and the invention is not limited to what is shown in the drawings and described in the specification.

What is claimed is:

1. A carrier ring for a drapery rod of the type having therethrough at least one longitudinal compartment communicating with the outside at the top, the bottom of said compartment serving as a track for the wheels of a draw ring, comprising:

a ring capable of surrounding said drapery rod;

a web, integral with the top of said ring, depending downwardly therefrom, and entering the longitudinal compartment of the rod when said ring is in position surrounding said rod; and a pair of wheels, connected by an axle integral with said web, positioned to roll on the track of the longitudinal compartment of the rod when said ring is in position surrounding said rod, wherein the axis of rotation of said wheels is offset longitudinally, with respect to the transverse median plane of said ring, in a direction opposite to the draw ring when moving in a closing direction; wherein said web has a sloped forward face, in the direction of said draw ring, inclined from top to bottom toward the rear, and a projection on the rearward face thereof capable of coming into contact with the sloping forward face of the web of another said carrier ring therebehind above the axis of rotation of the wheels of the other carrier ring, when both rings are in position on the rod.

* * * * *